US005888009A

United States Patent [19]

Toyama

[11] Patent Number: 5,888,009

[45] Date of Patent: Mar. 30, 1999

[54] WRITING TOOL AND PRESSURIZING CAP

[75] Inventor: Matsuhei Toyama, Tokyo, Japan

[73] Assignee: Zebra Co., Ltd., Tokyo, Japan

[21] Appl. No.: 930,251

[22] PCT Filed: Apr. 4, 1996

[86] PCT No.: PCT/JP96/00923

§ 371 Date: Oct. 3, 1997

§ 102(e) Date: Oct. 3, 1997

[87] PCT Pub. No.: WO96/31354

PCT Pub. Date: Oct. 10, 1996

[30] Foreign Application Priority Data

Apr. 4, 1995 [JP] Japan ..... 7-078662
Aug. 30, 1995 [JP] Japan ..... 7-221844

[51] Int. Cl.[6] ..... B43K 23/12

[52] U.S. Cl. ..... 401/188 A; 401/187; 401/213; 401/214

[58] Field of Search ..... 401/214, 188 A, 401/213, 187

[56] References Cited

U.S. PATENT DOCUMENTS 5,462,379 10/1995 Matsumoto et al. ..... 401/214 X

FOREIGN PATENT DOCUMENTS 62-22883 2/1987 Japan .
63-154284 10/1988 Japan .
6-39168 5/1994 Japan .
6-39169 5/1994 Japan .

*Primary Examiner*—Steven A. Bratlie
*Attorney, Agent, or Firm*—Greenblum & Bernstein, P.L.C.

[57] ABSTRACT

This invention relates to a writing tool for correction of misspelled words or a writing utensil such as a ball-point pen, in which air in a cap is pressurized in a process of pushing the cap onto and mounting the cap on an extremity end and the compressed air is forced into a liquid tank through an end of a tip to provide pressurization within the liquid tank. A distance from an opening end surface of a cap to an inner bottom portion of the cap is defined with respect to a distance from an end of a tip to near a cap loading base end of an extremity end. A resilient member is mounted on an outer periphery of the extremity end or in the cap for pushing back the cap to a normal mount position relative to the extremity end by releasing a pushing operation after the cap is pushed near the cap mounting base end. The cap can be automatically pushed back from the cap mounting base end to the normal mount position of the extremity end by means of the elastic member.

9 Claims, 11 Drawing Sheets

WRITING TOOL AND PRESSURIZING CAP

FIELD OF THE INVENTION

This invention relates to a coating tool for correcting wrong letters or a writing tool such as ball-point pen or the like, and more particularly, a writing tool constructed such that air in the cap is pressurized and compressed when the cap is pushed and loaded in respect to the tool tip, a rotary member projecting from the tool tip is retracted inwardly against a spring, and the compressed air in the cap is fed into the tool's liquid tank to increase the inner pressure.

BACKGROUND OF THE INVENTION

In general, this kind of writing tool, for example, a coating tool for correcting wrong letters by coating correction liquid, is constructed such that e.g., a rotary member held within the extremity end of the tip is biased by a spring and closely contacts the inward extremity edge of the tool tip closing the extremity end of the tip and preventing correction liquid from being discharged. In turn, the rotary member projecting from the extremity end of the tool tip maybe retracted and spaced apart from the inward extremity edge of the tip, against the spring to open the extremity end of the tip, whereupon the correction liquid in the liquid tank is discharged from the extremity end.

In the prior art, this kind of writing tool, as shown in FIG. 16, an inner cylinder 32 for pressurizing and compressing air is arranged within a cap 30 to closely contact an outer periphery of an extremity end 31, The cap 30 is pushed and loaded against the extremity end 31, air is pressurized and compressed in the inner cylinder 32, and the rotary member 34 held in the extremity end of the tip 33 is retracted inwardly toward the tip. The rotary member 34 is thereby moved away from the inward extremity edge of the tip 33, and the compressed air in the inner cylinder 32 is fed into the liquid tank 35 so as to increase an inner pressure in the liquid tank 35 (e.g., Japanese Utility Model Laid-Open publication No. Hei 6-39169).

Thus, as described in the paragraphs 13 through the 15 of page 7 of the laid-open specification, the prior art writing tool is constructed such that when the cap 30 is loaded in respect to the extremity end 31, the inner cylinder 32 of the cap 30 closely contacts the outer periphery of the extremity end 31 to make a sealed space preventing air leakage within the inner cylinder 32, and the air in the inner cylinder 32 is pressurized and compressed under the reduced volume of the sealed and closed space. Then, when the air in the inner cylinder 32 is pressurized and compressed, the rotary member 34 projecting from the tip 33 abuts a tongue 37 of a resilient valve opening member 36 arranged in The cap, the rotary member is then is retracted against the spring by the force of the tongue 37, in such a manner that the rotary member 34 is moved away from the inward extremity edge of the contacted tip 33, thereby feeding the compressed air in the inner cylinder 32 from the clearance formed between the rotary member 34 and the inward extremity edge into the liquid tank 35, pressurizing the liquid tank 35.

However, the tongue 37 of the valve opening member in the cap is cantilevered, this structure achieved by cutting and raising the cylindrical part of the valve opening member 36 inwardly. Accordingly, when the cap is loaded in respect to the extremity end, the rotary member projecting from the tip extremity end is retracted by means of the pushing force of the tongue against the spring. Accordingly, the pushing force of the tongue becomes attenuated within a short period of time when the cap is repeatedly fixed and removed and eventually, the rotary member is not retracted inwardly toward the tip against a the spring under the attenuated pushing force of the weakened tongue. Disadvantages of poor positive operation and poor stability result.

In order to cut and raise the tongue from the valve opening member, machining is required. Further when air in the inner cylinder is pressurized and compressed, the valve opening member must be assembled and arranged within the cap in a positional relation where the rotary member abuts the tongue. The assembling operation is there troublesome and expensive.

SUMMARY OF THE INVENTION

Accordingly, it is an object of the present invention to provide a writing tool in which inner pressure in a liquid tank is increased by feeding compressed air in the cap into the liquid tank during cap loading, and in which machining and assembling operations are easily carried out.

It is another object of the present invention to enable a valve opening operation in which the rotary member is moved away from the inward extremity edge of the tip for feeding the compressed air to the liquid tank, and in which the valve opening operation is maintained positively and stably for a long period of time under utilization of the inner bottom part of the cap.

Further, another object of the present invention is to provide the writing tool allowing an effective gripping action.

The writing tool of the present invention described above is constructed such that the rotary member is held within the extremity end of the tip to be held at the extremity end of the liquid tank while being resiliently sprung by a spring, contacted with the inward extremity edge of the tip and partially projected, the cap is pushed and loaded at the extremity end while closely contacted with an outer periphery of the extremity end holding the tip so as to make a sealingly closed tip, wherein the length of the cap is formed into a length ranging from the extremity end of the tip to a part near the cap loading base end, and in turn there is provided a resilient member in which the cap is pushed to the cap loading base end at the extremity end or a part near the cap loading base end in the cap, the pushing operation is released to cause the cap to be pushed back to the normal loading position.

In addition, the aforesaid resilient member is made of O-ring or leaf spring or spring.

Further, in accordance with the present invention, writing tool in which a rotary member is held within an extremity end of a tip held at an extremity end of a liquid tank under a state in which it is resiliently sprung by a spring, contacted with an inward extremity end of a tip and its part is projected, a cap is pushed onto and loaded on said extremity end under a state in which it is closely contacted with an outer periphery of the extremity end holding the tip so as to sealingly close the tip, the writing tool is characterized in that: a length ranging from an opening end surface of said cap to its inner bottom part is formed into a length ranging from an extremity end of the tip to a part near a cap loading base end of the extremity end and in turn there is installed a resilient member comprising O-ring or leaf spring for pushing back the cap to the normal loading position in respect to the extremity end by releasing the pushing operation after the cap is pushed onto an outer periphery of the cap loading base end of the extremity end to a part near the cap loading base end, thereafter the pushing operation is released. According to this, when the cap is pushed into and loaded up to a part near the cap loading base end at the extremity end and the opening end surface is abutted against the O-ring at the cap loading base end and further pushed into it, the O-ring is resiliently deformed between the opening end surface of the cap and the cap loading base end, the inner bottom part of the cap is abutted against the rotary member projected out of the extremity end of the tip, the rotary member is retracted inwardly toward the tip in such a manner that it is moved away from the inner extremity end edge of the tip against a spring to open the extremity end of the tip and in turn, after the O-ring is resiliently deformed, thereafter the cap pushing operation is released, resulting in that the cap is automatically pushed back to the normal loading position at the extremity end by a recovering force (a resilient force) when it is returned to its original state before deformation, and at the same time the inner bottom part is moved away from the rotary member, the rotary member is contacted with the inner extremity end edge of the tip by a spring to close the extremity end of the tip. Thereafter the pushing operation is released, resulting in that the cap is automatically pushed back to the normal inserting and loading position at the extremity end by a spring force when the leaf spring is returned back to its original state before its deformation.

In addition, according to the present invention, the cap is pushed and loaded at the extremity end while closely contacted with an outer periphery of the extremity end holding the tip so as to make a sealingly closed tip, the writing tool is characterized in that: a length of said cap is formed into a length ranging from an extremity end of the tip to a part near a cap loading base end of the extremity end and in turn there is installed at the cap loading base end at the extremity end a resilient member for pushing back the cap to the normal loading position in respect to the extremity end by releasing the pushing operation after the cap is pushed to a part near the cap loading base end. Accordingly, as aforementioned, during a case in which the cap is pushed into and loaded up to a part near the cap loading base end at the extremity end, the inner bottom part of the cap is abutted against the rotary member projected out of the extremity end of the tip, the rotary member is retracted inwardly in a tip in such a manner that it may be moved away from the inner extremity end edge of the tip against the spring so as to open the extremity end of the tip, and in turn, the opening end surface of the cap is abutted against the resilient member at the cap loading base end and in a state in which the resilient member is being deformed, the cap pushing operation is released, resulting in that the cap is pushed back automatically by the resilient member to the normal loading position at the extremity end and concurrently the inner bottom part is moved away from the rotary member, the rotary member is contacted with the inner extremity end edge of the tip so as to close the extremity end of the tip.

In addition, according to the present invention, the cap is pushed and loaded at the extremity end while closely contacted with an outer periphery of the extremity end holding the tip so as to make a sealingly closed tip, the writing tool is characterized in that: a length ranging from an opening end surface of said cap to its inner bottom part is formed into a length as one ranging from an extremity end of the tip to a part near a cap loading base end of the extremity end, and there is installed a resilient member at an outer periphery of the extremity end for pushing back the cap to the normal loading position in respect to the extremity end by releasing the pushing operation after the cap is pushed to the cap loading base end of said extremity end, the resilient member is provided with a cap returning resilient part formed into a cylindrical shape extending from the cap loading base end of said extremity end toward the extremity part and projected in annular form in a circumferential direction along one end opening edge of the cylinder abutted against the cap loading base end. Accordingly, during the loading process of the cap against the extremity end, the cap returning resilient part of the resilient member is pushed by the opening end surface of the cap and resiliently deformed and concurrently as its resilient deformation, the inner bottom part of the cap is abutted against the rotary member projected out of the extremity end of the tip to cause the rotary member to be retracted inwardly into the tip against the spring and to feed the compressed air in the cap pressurized and compressed into the liquid tank and then the valve structure at the tip extremity end is opened. In turn, as the cap pushing operation is released, the cap is pushed back to the normal loading position of the extremity end by a recovering force of the cap returning resilient part and concurrently, the inner bottom part is moved away from the rotary member, the rotary member is contacted with the inner extremity end of the tip to close the valve structure of the tip extremity end. In addition, the cylinder part of the resilient member may perform a gripping action for preventing a slippage at the time of correcting wrong letters.

Further, another feature of this invention is that an annular end surface of at least the cap returning resilient part is provided with an indent recess for assuring and forming a deformed space augmenting resilient action of the cap returning resilient part therebetween and the cap loading base end of the extremity end. According to this, during the cap loading action against the extremity end, the cap returning resilient part of the resilient member is, as described in the above, is pushed by the opening end surface of the abutted cap and resiliently deformed in such a manner that it may be set toward the deformed space between it and the cap loading base end and in turn as the cap pushing operation is released, the cap is pushed back to the normal loading position for the extremity end by a recovering force of the cap returning resilient part augmented by the compressed air in the deformed space.

Further, another feature of this invention is that the aforementioned cap includes a transparent cap main body formed in an inner diameter larger about twice than an outer diameter of the extremity end, and a colored cylindrical inner cap with a bottom which is coaxially assembled at a tail end of the cap main body, internally installed there, closely contacted with an outer periphery of the extremity end to sealingly close the tip during loading of the extremity end, the inner bottom part being abutted against the rotating member projected from the extremity end of the tip to retract said rotary member inwardly into the tip, and a loading and moving amount of the rotary member in respect to the extremity end when the rotary member is spaced apart from the inward extremity edge of the tip is restricted under abutment of the extremity end against the extremity end surface. According to this, the colored inner cap acting as one for sealingly enclose the tip at the outer periphery of the extremity end and for pressuring and compressing the inner air during the cap loading process against the extremity end, and acting as one for moving the rotary member away from the inner extremity end edge of the tip so as to feed the pressurized and compressed air into the liquid tank so as to open the valve structure at the tip extremity end is installed inside the cap main body, resulting in that an ornamental effect of the cap can be realized. In addition, the inner cap is abutted against the extremity end surface of the extremity end when the valve structure at the tip extremity end is opened so as to restrict a loading and moving amount of the cap in respect to the extremity end abutted against the extremity end surface of the extremity end, resulting in that the compressed air in the inner cap is positively fed into the liquid tank. Namely, when the valve structure at the tip extremity end is opened, movement of the cap is received so that the tip extremity end may not be closed by the inner bottom of inner cap for making the rotary member receded and thus that compressed air in the inner cap may be surely fed into the liquid tank.

DETAILED DESCRIPTION OF THE PREFERRED EMBODIMENTS

Figure 1A:
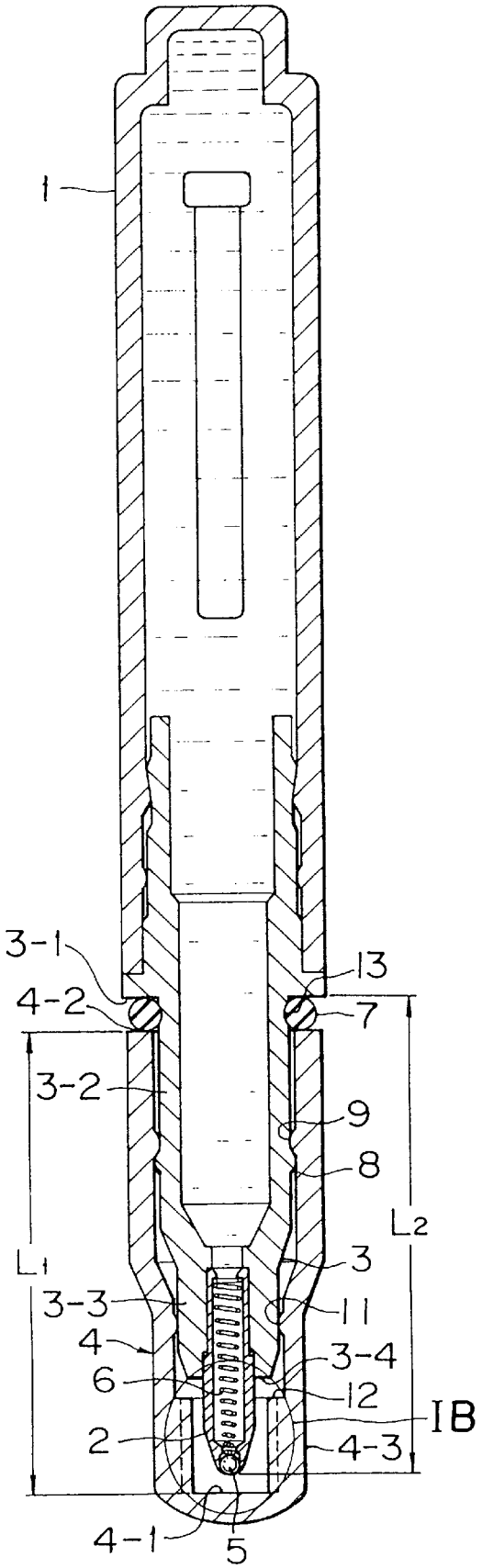
FIG. 1A is a longitudinal section for showing an embodiment of the writing tool of the present invention.

Referring now to the drawings, preferred embodiments of the present invention will be described as follows.

FIGS. 1A to 3B illustrate an embodiment of the writing tool of the present invention on claims 1 and 2, wherein a liquid tank 1 is formed in either of a pen type or a bottle type, an extremity end 3 for holding a tip 2 is loaded at an extremity part of the liquid tank, a cap 4 is pushed and loaded up to a part near a cap loading base end 3-1 (circumferential step) of the extremity end 3 while being closely contacted with an outer (cylindrical) circumference of the extremity end 3, thereby an inner bottom part 4-1 (inner end surface) of the cap 4 is abutted against a rotary member 5 projecting from the extremity part of the tip 2 so as to cause the rotary member 5 to be retracted inwardly toward the tip 2 in such a manner that the rotary member is spaced apart from an inward extremity edge 2-1 (retaining rim) of the tip 2 against a spring 6, whereby the extremity end of the tip 2 is opened (unblocked), compressed air in the cap 4 pressurized and compressed during a pushing and loading step of the cap 4 is fed into the liquid tank 1 and then an inner pressure of the liquid tank 1 is increased.

Then, at the outer periphery of the cap loading base end 3-1 of the extremity end 3 is installed an O-ring 7 for automatically pushing back the cap 4 to the normal loading position of the extremity end 3 by releasing the pushing operation after the cap 4 is pushed and loaded up to a part near the cap loading base end 3-1.

In this case, the normal loading position of the cap 4 against the extremity end 3 is defined as a state in which an annular projection 9 at the inner surface of the cap 4 is engaged with an annular projection 8 at the outer periphery of the extremity end 3.

The tip 2 and the extremity end 3 are substantially of a well-known structure. That is, the tip 2 is formed into a pipe (channel) with proper metallic material, an opening edge at the extremity end formed narrow at its end is drawn by a press fitting and the like, an inward directed extremity is arranged at the extremity end and concurrently a radial longitudinal groove 10 formed by a broach machining operation is arranged inside the edge, the rotary member 5 is held at the inside extremity end between the longitudinal groove 10 and the inner extremity edge 2-1 under one state in which the rotary member is being resiliently urged and contacted with the inward directed extremity edge 2-1 and the other state in which its part is being projected from the inward directed extremity edge 2-1. The extremity end 3 has a straight large-diameter cylindrical part 3-2 ranging from the cap loading base end 3-1 to the midway part directed toward the extremity end for holding the tip 2, the extremity end is formed into a stepped cylindrical shape of narrow end formed substantially into a narrow straight toward its end and then the tip 2 is press fitted into and held at a small-diameter cylinder part 3—3 at the extremity end.

Figure 3A:
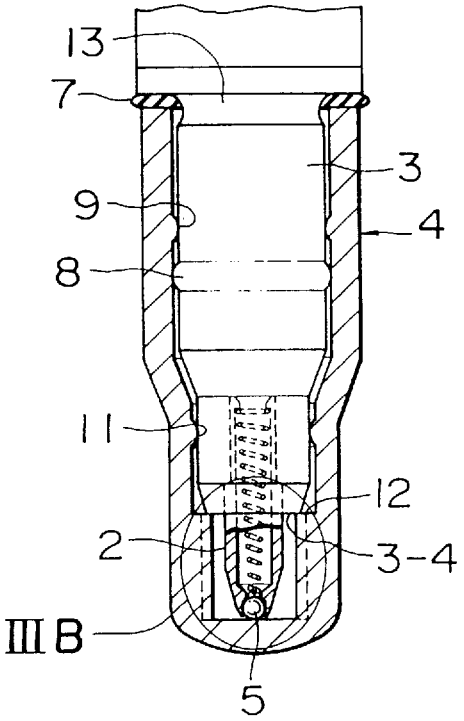
FIG. 3A is a longitudinal section for showing a state (a valve opened state) in which a cap is loaded up to a part near a cap loading base end at an extremity end and a rotary member projecting from an extremity end of a tip is retracted toward an inside of the tip with an inner bottom part of the cap.
Figure 3B:
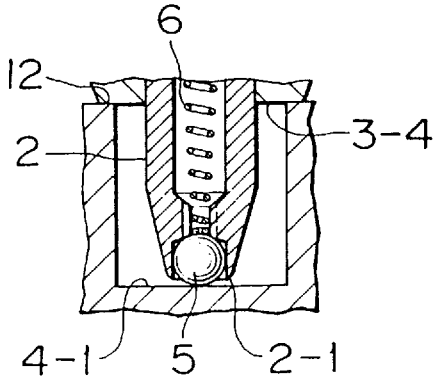
FIG. 3B is an expanded view of portion IIIB of FIG. 3A.

The cap 4 is formed into a stepped shape with a narrow end thereof in compliance with an outer shape of the extremity end 3, and a length LI ranging from an opening end surface 4-2 (rim) to an inner bottom part 4-1 is formed into a length L2 ranging from the extremity end of the tip 2 from which the rotary member 5 is projected to a part near the cap loading base end 3-1 of the extremity end 3. In other words, the length is formed into the length LI in which, when the cap 4 is loaded up to a part near the cap loading base end 3-1 of the extremity end 3, as shown in FIG. 3A and 3B the opening end surface 4-2 of the cap 4 is abutted against the O-ring 7 at the cap loading base end 3-1 so as to cause the O-ring 7 to be resiliently deformed and concurrently the inner bottom part 4-1 is abutted against the rotary member 5 projected from the extremity end of the tip 2, the rotary member 5 can be retracted inwardly toward the tip 2 against the spring 6 in such a manner that it is spaced apart from the inward extremity edge 2-1.

Reference numeral 11 in the figure denotes an annular projection arranged at the inner (circumferential) surface of the reduced diameter part 4-3 of the cap 4 and this projection may act to be closely contacted with the outer periphery of the reduced diameter part 3—3 of the extremity end 3 during a process in which the cap 4 is pushed and loaded against the extremity end 3 so as to compress the air in the cap 4.

In addition, the reduced diameter part 4-1 of the cap 4 is provided with a proper height step 12 directed from the inner bottom part 4-1 toward the opening end surface 4-1 so as to be operated such that when the cap 4 is loaded against the extremity end 3 to cause its inner bottom part 4-1 to abut against the rotary member 5 and further to cause the rotary member 5 to be retracted, it is abutted against the extremity end surface 3-4 of the extremity end 2 so as to restrict a loading and moving amount of the cap 4 in respect to the extremity end 3.

That is, it is constructed such that a motion of the cap 4 is received when the extremity end of the tip 2 is opened through abutment of the inner bottom part 4-1 against the rotary member 5 without being influenced by a force of a user when the cap 4 is loaded, the inner bottom part 4-1 is prevented from being abutted against the inward extremity edge 2-1 of the tip 2. That is, the compressed air within the cap 4 is fed positively from a clearance between the rotary member 5 and the inward-directed extremity edge 2-1 into the liquid tank 1 while the extremity end of the opened (unblocked) tip 2 is not clogged by the inner bottom part 4-1 of the cap 4 (a "pressurizing position" as shown in FIG. 3B).

The O-ring 7 is resiliently deformed during a step in which the cap 4 is pushed into and loaded to a part near the cap loading base end 3-1 of the extremity end 3 so as to push back the cap 4 automatically to the normal loading position in respect to the extremity end 3 when its pushing operation is released (a user's hand is removed from the cap 4). That is, during the aforesaid loading step of the cap 4, the O-ring 7 may act to release the pushing of the rotary member 5 in such a manner that the rotary member 5 retracted inwardly in the tip 2 against the spring 6 through abutment of the inner bottom part 4-1 is contacted again with the inner-directed extremity edge 2-1 with the spring 6 to cause the extremity end of the tip 2 to be closed (blocked), the O-ring 7 is made of resilient materials, such as silicone rubber or soft resin or foamed styrol or the like capable of realizing a recovering force (a resilient force) for pushing back the cap from its state resiliently deformed by the opening end surface 4-1 of the cap 4 to the normal loading position of the extremity end 3, and the O-ring 7 is installed at the engaging groove 13 arranged at the cap loading base end 3-1.

Figure 4:
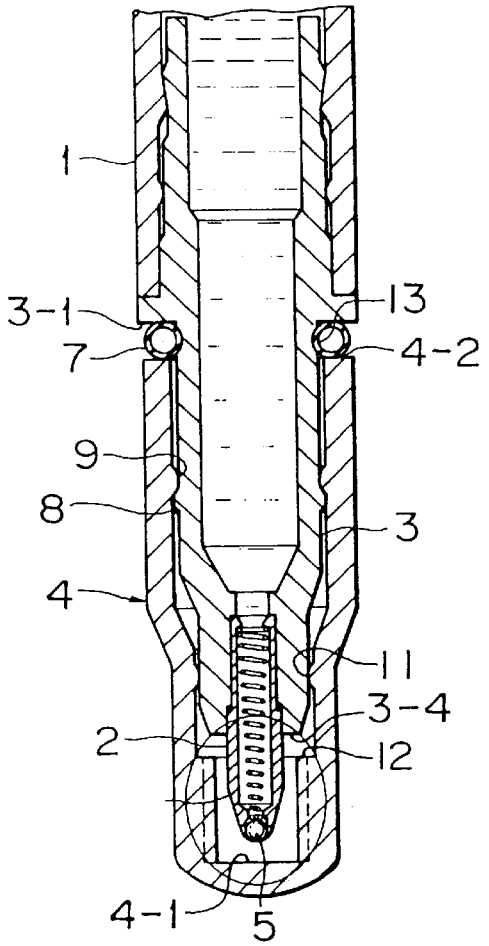
FIG. 4 is a longitudinal section for showing another embodiment of the writing tool of the present invention.
Figure 5A:
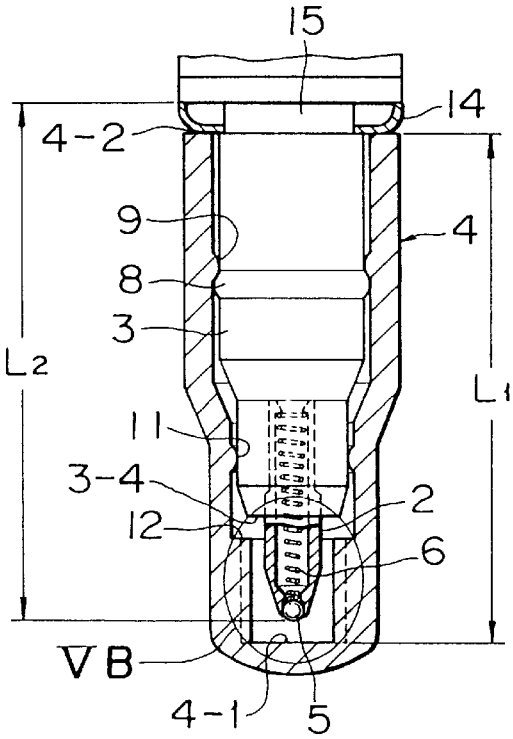
FIG. 5A is a longitudinal section for showing an embodiment of the writing tool of the present invention.
Figure 5B:
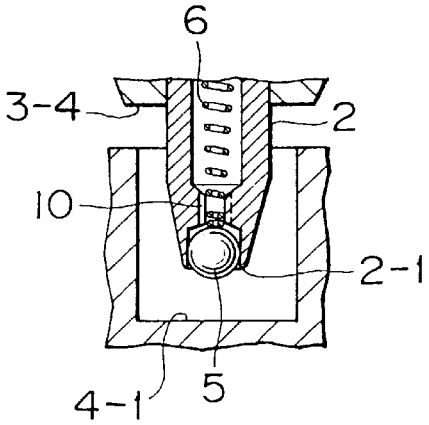
FIG. 5B is an expanded view of VB portion of FIG. 5A.

As illustrated in FIG. 4 in a second embodiment, the O-ring 7 may be formed into a hollow shape. In this case, enclosures such an air or gel-like substances may sometimes be enclosed in the hollow space in such a degree as one to enable a recovering force (a resilient force) to be attained for pushing back the cap 4 to the normal loading position of the extremity end 3.

An example of use of the writing tool of the present embodiment constructed as described above will be described as follows, wherein the cap 4 is pushed onto the extremity end 3 from a state (a "writing position" of the rotary member 5 in FIG. 2) in which the annular projection 11 at the inner surface of the cap 4 is closely contacted with the outer periphery of the extremity end 3, until the opening end surface 4-2 of the cap 4 is abutted against the O-ring 7 at the cap loading base end 3-1 to cause the O-ring 7 to be resiliently deformed. Then, during a step in which the inner stepped part 12 of the cap 4 is abutted against the extremity end surface 3-4 of the extremity end 3, the O-ring 7 is resiliently deformed, the inner bottom part 4-1 of the cap 4 is abutted against the rotary member 5 projected from the extremity end of the tip 2 to cause the rotary member 5 to be retracted inward in the tip 2 in such a manner that it is spaced apart from the inward extremity edge 2-1 of the tip 2 against the spring 6 and then the valve structure at the extremity end of the tip 2 is opened (unblocked, i.e., the "pressurizing position" of the rotary member 5 shown in FIGS. 3A & 3B).

Figure 1B:
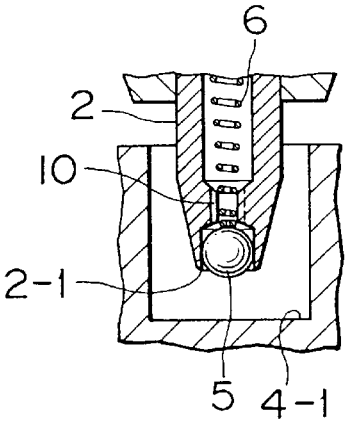
FIG. 1B is an expanded view of IB portion of FIG. 1A.
Figure 2:
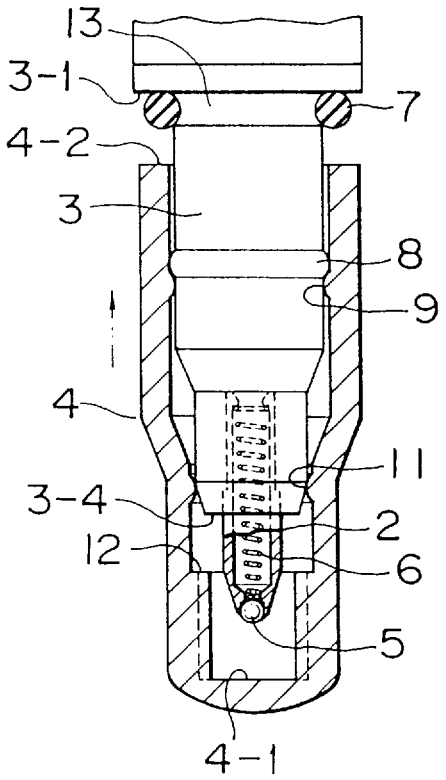
FIG. 2 is a longitudinal section for showing a substantial part to indicate a cap loading step against an extremity end.

That is, from the normal cap-loading position in respect to the extremity end 3 as shown in FIGS. 1A & 1B, the cap 4 is pushed against the extremity end 3 until the opening end surface 4-2 of the cap 4 is abutted against the O-ring 7 at the cap loading base end 3-1 to make a resilient deformation of the O-ring 7 in its push crushed state, the inner bottom part 4-1 of the cap 4 spaced apart from the extremity end of the tip 2 is abutted against the rotary member 5 projected from the extremity end of the tip 2 to cause the rotary member 5 to be retracted inward of the tip 2 in such a manner that the rotary member is spaced apart from the inner extremity edge 2-1. With such an arrangement as above, the valve structure at the extremity end of the tip 2 is opened, the compressed air within the cap 4 is fed positively from a clearance between the opened inner extremity edge 2-1 and the rotary member 5 into the liquid tank 1 so as to increase the inner pressure within the liquid tank 7.

In turn, after the cap 4 is pushed onto the extremity end 3 until the O-ring 7 at the cap loading base end 3-1 is resiliently deformed as described above, the pushing operation is released (the cap 4 is removed), resulting in that the cap 4 is pushed back to the normal loading position against the extremity end 3 with the recovering force when the O-ring 7 returns to its original state before its deformation and concurrently the inner bottom part 4-1 of the cap 4 is moved away from the rotary member 5 (returned back to the state shown in FIG. 1A).

With such an arrangement as above, the rotary member 5 is contacted with the inner extremity edge 2-1 of the tip 2 by the spring 6 and then the valve structure at the extremity end is closed. (refer to FIG. 1B)

FIGS. 5A to 6B illustrate a third embodiment of the writing tool of the present invention, wherein this embodiment is constructed such that, as the resilient member for use in pushing back the cap 4 from the part near the cap loading base end 3-1 of the extremity end 3 to its normal loading position, a ring-shaped leaf spring 14 is loaded at the cap loading base end 3-1 of the extremity end 3 in place of the O-ring 7 described in detail in the aforesaid embodiments and then the cap 4 is pushed back from the part near the cap loading base end 3-1 of the extremity end 3 to its normal loading position with the spring force of the leaf spring 14. Otherwise, since remaining portions the aforesaid third embodiment are substantially similar to those of the detailed first embodiment described above expecting features directed to the leaf spring 14, the same reference numerals are applied to the same elements and the description thereof is omitted.

The leaf spring 14 is of a ring-shape freely fitted to the engaging groove 15 arranged at the cap loading base end 3-l of the extremity end 3, and formed into a substantial disk-shape having its inside part of the ring expanded to be deformable.

Figure 6A:
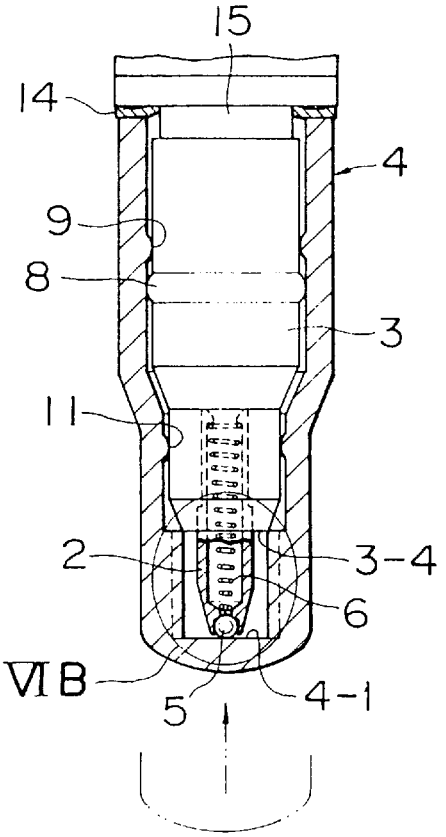
FIG. 6A is a longitudinal section for showing a state (a valve opened state) in which a cap is loaded up to a part near a cap loading base end at an extremity end and a rotary member projecting from an extremity end of a tip is retracted toward an inside part of the tip with an inner bottom part of the cap.
Figure 6B:
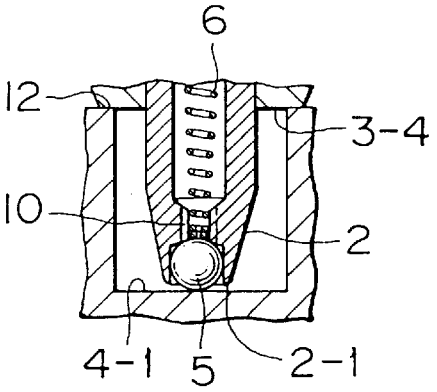
FIG. 6B is an expanded view of VIB of FIG. 6A.
Figure 7A:
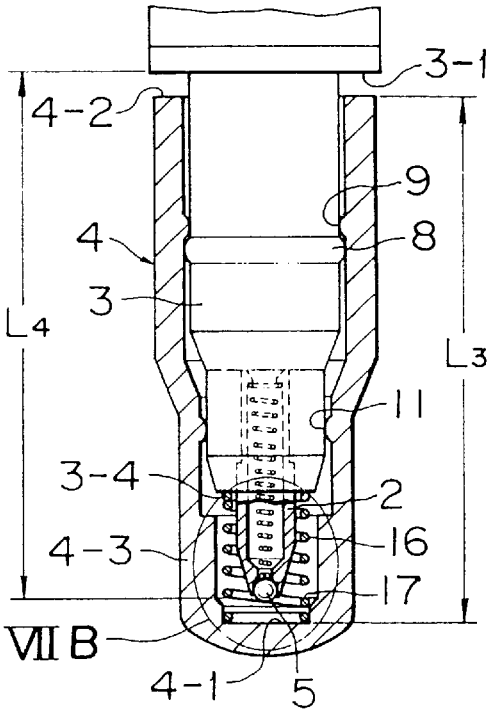
FIG. 7A is a longitudinal section for showing one example of an embodiment of the writing tool of the present invention.
Figure 7B:
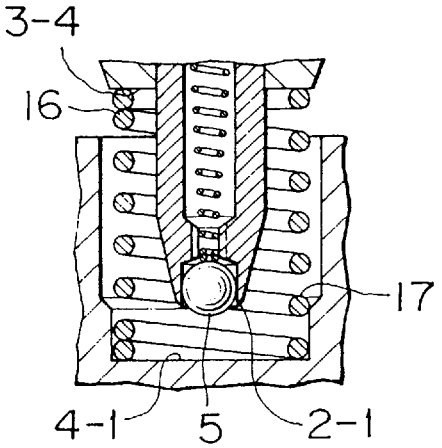
FIG. 7B is an expanded view of VIIB portion of FIG. 7A.
Figure 8A:
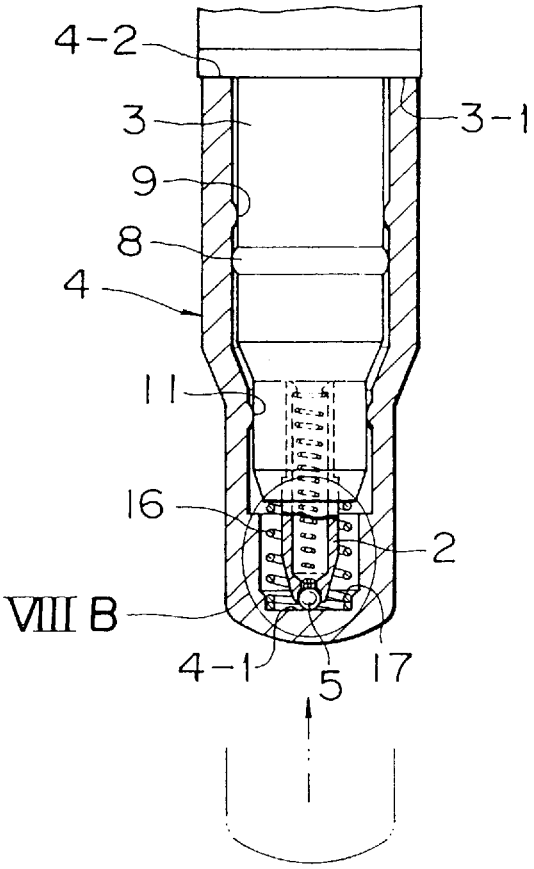
FIG. 8A is a longitudinal section for showing a state (a valve opened state) in which a cap is loaded up to a part near a cap loading base end at an extremity end and a rotary member projecting from an extremity end of a tip is retracted toward an inside part of the tip with an inner bottom part of the cap.
Figure 8B:
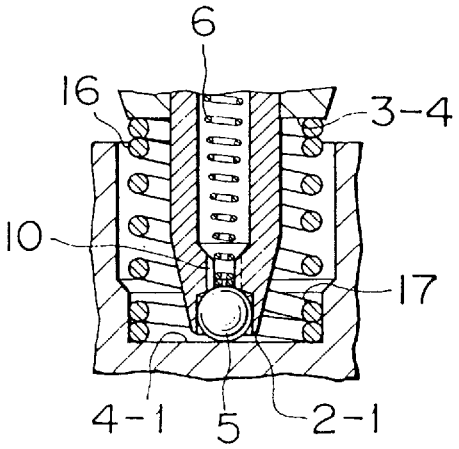
FIG. 8B is an expanded view of VIIIB portion of FIG. 8A.

In this way, in the case of the writing tool of the third embodiment, the opening end surface 4-2 of the cap 4 is abutted against the leaf spring 14, the cap 4 is pushed further up to a part near the cap loading base end 3-1 for deforming the leaf spring 14 (a state in FIG. 6A), the inner bottom part 41 of the cap 4 causes the rotary member 5 projected from the extremity end of the tip 2 to be retracted inwardly toward the tip 2 against the spring 6 as described in detail in the above embodiment and then the valve structure at the extremity end of the tip 2 is opened (refer to FIG. 6A). Then, the pushing operation of the cap 4 is released, the cap 4 is pushed back to the normal loading position of the extremity end 3 with the spring force of the leaf spring 14 and the valve structure at the extremity end of the tip 2 is closed.

FIGS. 7A to 8B illustrate a fourth embodiment of the writing tool of the present invention, wherein a spring 16 is loaded in the reduced diameter part 4-3 of the cap 4 and the cap 4 is pushed from the cap loading base end 3-1 of the extremity end 3 to the normal position of the extremity end 3 with a force of the spring 16. In the fourth embodiment features that are substantially similar to those of the first embodiment described above, e.g., generally excepting the length of the cap 4 itself and the arrangement of the spring 16, are identified by the same reference numerals and the description thereof is omitted.

The cap 4 is constructed such that a length L3 ranging from the opening end surface 4-2 to the inner bottom part 4-1 is formed into a length L4 ranging from the extremity end of the tip 2 from which the rotary member 5 projects to the cap insertion and loading base end 3-1 of the extremity end 3, the cap 4 is pushed onto the extremity end 3 and loaded there until the opening end surface 4-2 is abutted against the cap insertion and loading base end 3-1, thereby the inner bottom part 4-1 is abutted against the rotary member 5 projected from the extremity end of the tip 2, the rotary member 5 is retracted inwardly toward the tip 2 in such a manner that the rotary member 5 is spaced apart from the inner extremity edge 2-1 against the spring 6 and the valve structure at the extremity end of the tip 2 is opened.

That is, a loading and moving amount of the cap 4 in respect to the extremity end 3 is restricted under an abutment between the opening end surface 4-2 of the cap 4 and the cap loading base end 3-1 (a state in FIG. 8A), and the opened valve structure at the extremity end of the tip 2 (the inward extremity edge 2-1) is not prevented from being clogged by the inner bottom part 4-1 of the cap 4. (a state in FIG. 8B)

The spring 16 is formed to have a proper length with such an outer diameter as one capable of being freely inserted into the reduced diameter part 4-3 of the cap 4, its one end is supported by a press fitting at a supporting stepped part 17 formed slightly smaller than the outer diameter of the spring 16 at the inner bottom part 4-1 of the reduced diameter part 4-3 and the spring is coaxially installed within the reduced diameter part 4-3 while being projected from the reduced diameter part 4-3 toward the opening end of the cap 4.

Figure 9:
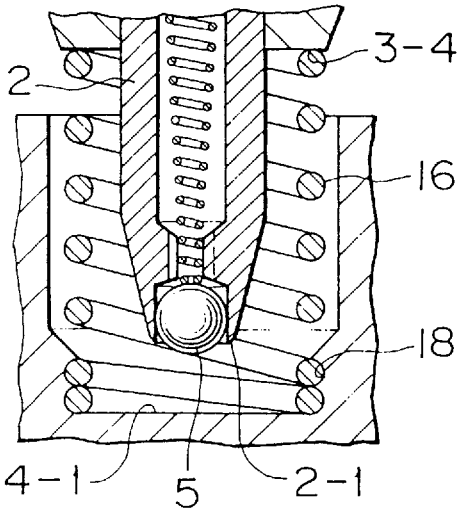
FIG. 9 is a partial enlarged view for showing another embodiment of a spring supporting state.

In addition, as means for supporting one end of the spring 16 at the supporting step 17 of the reduced diameter part 4-3, this is not limited to the press fitting, but various means can be optionally attained such as supporting through screw thread by arranging a helical groove le at the inner surface of the reduced diameter part 4-3 as shown in FIG. 9 to enable several turns at one end of the spring 16 to be supported.

Thus, in accordance with the writing tool of the embodiment described above, when the cap 4 is pushed and loaded onto the extremity end 3 until the opening end surface 4-1 of the cap 4 is abutted against the cap loading base end 3-1, the spring 16 is gradually compressed from the time when the other end of the spring is abutted against the extremity end surface 3-4 of the extremity end 3 during that operation, the inner bottom surface 4-1 of the cap 4 is abutted against the rotary member 5 projected out of the extremity end of the tip 2, the rotary member 5 is retracted inwardly toward the tip 2 so as to open the valve structure at the extremity end of the tip 2. In turn, after the cap 4 is pushed onto the extremity end 3 until the opening end surface 4-2 of the cap 4 is abutted against the cap loading base end 3-1 (a state in FIG. 8A), the pushing operation of the cap 4 is released, the cap 4 is pushed back to the normal loading position of the extremity end 3 by the spring 16 expanded with the other end of the spring being abutted against the extremity end surface 3-4 of the extremity end 3 (returned back the state shown in FIG. 7A). With such an arrangement as above, the inner bottom part 4-1 of the cap 4 is spaced apart from the rotary member 5, the rotary member 5 is contacted with the inward extremity edge 2-1 of the tip 2 by the spring 6 to close the valve structure at the extremity end. (a state in FIG. 7B)

Accordingly, in accordance with the writing tool of the present invention constructed as above, the fact that an inner pressure in the liquid tank is increased by feeding compressed air into the liquid tank as well as the fact that O-ring, leaf spring or spring of which machining and fixing can be easily carried out are utilized as a resilient member for pushing back the cap to the normal loading position in respect to the extremity end after feeding the compressed air into the liquid tank to pressurize an inside part of the liquid tank during a loading process of the cap in respect to the extremity end enable its machining and assembling to be substantially simplified as compared with that of the prior art writing tool and further enable its manufacturing cost to be reduced. The valve opening operation for retracting the rotary member projected out of the extremity end of the tip inwardly toward the tip so as to feed the compressed air into the liquid tank is performed in such a manner that the rotary member is abutted against the inner bottom part of the cap, so that the valve opening operation can be maintained positively and stably for a long period of time without being damaged in a short period of time as found in the prior art writing tool.

FIGS. 10 to 13B illustrate a fifth embodiment of the writing tool of the present invention, wherein a cylindrical resilient member 19 is loaded at an outer periphery of the extremity end 3, a cap 21 is pushed and loaded up to a cap loading base end 3-1 (circumferential step) in respect to the extremity end 3 with a cap returning resilient part 20 (resilient circumferential ring) arranged at an outer periphery of the cylindrical part 19-1 of the resilient member 19 to be described later, thereafter the pushing operation is released to cause the cap 21 to be automatically pushed back to the normal loading position of the extremity end 3. Then, the cap 21 is comprised of a cap main body 21-2 and an inner cap 21-3, and during a process in which the cap 21 is loaded in respect to the extremity end 3, the (inner circumferential surface of the) inner cap 21-3 is closely contacted with the outer periphery (outer cylindrical surface) of the extremity end 3 to compress the air within the inner cap 21-3 contacted with the rotary member 5 projected out of the extremity end of the tip 2, the rotary member 5 is spaced apart from the inward extremity edge 2-1 retaining rim of the tip 2 against a spring 6 as to open (unblock) the valve structure at the extremity end of the tip 2 comprised of the rotary member 5 and the inward extremity edge 2-1. Elements of this embodiment that are substantially similar to the first embodiment described above generally excepting the form of the resilient member 19 for use in returning the cap 21 and the form of the cap 21 are identified by the same reference numerals, and the description thereof is omitted.

The normal loading position of the cap 21 the respect to the extremity end 3 in such an embodiment as above is defined as a state in which the cap 21 is retracted and returned back in a direction where the cap is pulled out of the extremity end 3 by the resilient member 19, and the inner bottom part 21-1 (inner end surface) of the inner cap 21-3 is spaced apart from the rotary member 5. That is, the inner bottom part 21-1 of the inner cap 21-3 is spaced apart to cause the rotary member 5 to be resiliently sprung by the spring 6 and contacted with the inward extremity edge 2-1 of the tip 2 and the valve structure at the extremity end of the tip 2 is closed (block).

The extremity end 3 comprises a large diameter cylindrical part 3-2 having a straight segment ranging from the cap loading base end 3-1 toward the midway part of extremity end side holding the tip 2, as described in detail in reference to the aforesaid embodiment, this is formed into a fine narrow end stepped cylindrical shape (outer circumferential surface) formed substantially straight, and the tip 2 is held by being press fitted to the reduced diameter cylindrical part 3—3 at the extremity end. Then, in the embodiment, an outer periphery of the large diameter cylindrical part 3-2 of the extremity end 3 is provided with an indent part 22 so as to enable the resilient member 19 to be strictly loaded in flush with the outer periphery of the large diameter cylindrical part 3-2.

The indent part 22 is formed in compliance with a thickness of a cylindrical wall of the cylindrical part 19-1 of the resilient member 19 within a range over an entire length from the cap loading base end 3-1 to the substantial full length of the large diameter cylindrical part 3-2. Then, an annular groove 23 having an appropriate width and depth is arranged along an opening edge at the bottom part of the indent part 22 located at the reduced diameter cylindrical part 3—3, and an annular projection 24 of the resilient member 19 to be described later is formed to be engaged through a fastening action.

The cap 21 includes a cap main body 21-2; and an inner cap 21-3 which is coaxially assembled at a tail end of the cap main body 21-2, installed internally thereof, sealingly contacted with an outer periphery of the reduced diameter cylindrical part 3—3 of the extremity end 3 during a step in which the cap main body 21-2 is loaded at the extremity end 3, and for sealingly closing the tip 2 projected from the reduced diameter cylindrical part 3—3.

The cap main body 21-2 is made of transparent synthetic resin material to be formed into a cylindrical shape having an inner diameter which is larger about twice than an outer diameter of the large diameter cylindrical part 3-2 of the extremity end 3r and the cap main body 21-2 covers the extremity end 3 under a state in which a clearance 25 to cause inner air to be naturally retracted is kept between it and the outer periphery of the large diameter cylindrical part 3-2 of the extremity end 3 during its loading step in respect to the extremity end 3. Then, a length L5 ranging from the opening end surface 21-20 to the inner bottom part 21-1 of the inner cap 21-3 is formed to be about a length L6 ranging from the extremity end of the tip 2 from which the rotary member 5 projects to a part near the cap loading base end 3-1 of the extremity end 3.

The inner cap 21-3 is formed of colored synthetic resin material and made into a cylindrical shape having a bottom part with an inner diameter closely contacted with an outer periphery of the reduced diameter cylindrical part 3—3 of the extremity end 3 and a proper length, the inner surface directed inwardly from the opening edge is formed with a stepped part 26 abutted against the extremity end surface 3-4 of the reduced diameter cylindrical part 3—3 during the loading step in respect to the extremity end 3 so as to restrict a loading and moving amount of the cap 21 in respect to the extremity end 3, and the inner cap 21-3 is coaxially assembled and internally arranged at the tail end under a fixed state in which it is fitted and engaged with an installing port 27 opened coaxially at the tail end of the cap main body 21-1.

In this case, the cap 21 sealingly closes the tip 2, pressurizes the inner air, retracts the rotary member 5 inwardly into the tip 2 so as to move the rotary member apart from the inward extremity edge 2-1 for feeding the compressed air into the liquid tank 1, assembles the colored inner cap 21-3 acting to open the valve structure located at the extremity end of the tip 2 into the transparent cap main body 21-2 and internally installing the inner cap in the cap main body,. Then, the inner cap 21-3 causes the stepped part 26 to be abutted against the extremity end surface 3-4 of the reduced diameter cylindrical part 3—3 of the extremity end 3 when the valve structure located at the extremity end of the tip 2 is opened with the inner bottom part 21-1 during its loading step in respect to the extremity end 3, so as to restrict a loading and moving amount of the cap 21 in respect to the cap 21. That is, as described in detail in the aforesaid embodiment, it may accept the motion of the cap 21 to prevent the inward extremity edge 2-1 of the tip 2 from being closed with the inner bottom part 21-1 of the inner cap 21-3 without being influenced by a degree of force applied by a user in case of loading the cap 21 when the valve structure is opened through abutment with the rotary member 5. That is, the compressed air within the inner cap 21-3 is positively fed from the clearance between the rotary member 5 of which valve is opened and the inward extremity edge 2-1 into the liquid tank 1 (the "pressurizing position" of the rotary member 5 shown in FIG. 13B).

A resilient member 19 is formed into a cylindrical shape having such a thickness, length and outer diameter to be flush with an outer periphery of the large diameter cylindrical part 3-2 within the indent part 22 arranged in the large diameter cylindrical part 3-2 of the extremity end 3, and the opening edge at one end of the cylindrical part 19-1 is provided with a cap returning resilient part 20 projected in an annular form in a peripheral direction.

The cylindrical part 19-1 may provide a gripping action to prevent a holding part from being slid during use of the writing tool to correct written wrong letters, an annular projection 24 fitted to and engaged with the annular groove 23 arranged at the bottom part of the indent part 22 is get at an inner periphery of the other end opening edge of the cylindrical part, and then the cylindrical part 19-1 can be fixed and held in the indent part 22 without being removed from it and flush with the outer periphery of the large diameter cylindrical part 3-2 under a fastening action worked on the annular projection 24 like a rubber band.

The cap returning resilient part 20 is resiliently deformed while being pushed by the opening end surface 21-20 of the cap 21 during a loading step in respect to the extremity end 3, recovered and deformed when its pushing operation is released (the hand is moved away from the cap 21) so as to act to push back the cap 21 automatically to the normal loading position in respect to the extremity end 3. That is, after the inner bottom part 21-1 of the inner cap 21-3 abuts against the rotary member 5 and retracts it inwardly toward the tip 2 against the spring 6 during the aforesaid loading process, it may act to release the pushed state of the rotary member 5 in such a manner that the rotary member 5 is contacted again with the inward extremity edge 21-1 by the spring 6 to close the valve structure located at the extremity end of the tip 2, wherein at a state in which one end opening edge of the cylindrical part 19-1, more particularly the cylindrical part 19-1 is being loaded at the indent part 22 of the extremity end 3, it may be arranged in a rectangular annular form in a circumferential direction along an opening edge of the opening end abutted against the cap loading base end 3-1 at a projecting height having a substantial same diameter as an outer diameter of the cap main body 21-2 (on outer diameter of the opening of the opening end surface 21-20).

Figure 11A:
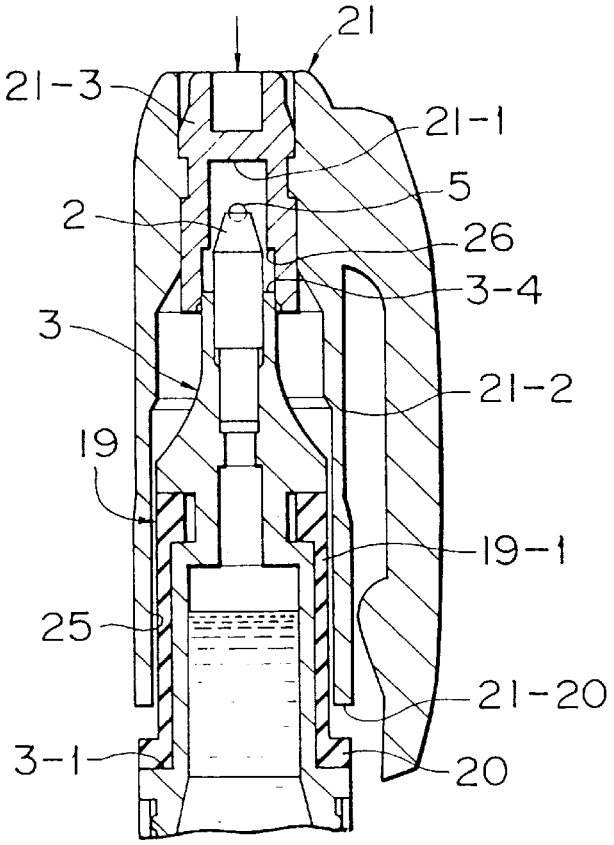
FIG. 11A is a longitudinal section for showing a state in which an inner cap is closely contacted with an outer circumference of the extremity end during a loading step against the extremity end.
Figure 11B:
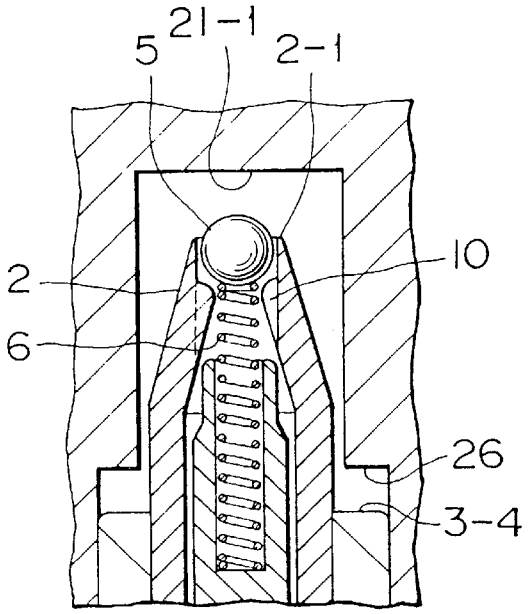
FIG. 11B is an expanded sectional view of main point of FIG. 11A.
Figure 12:
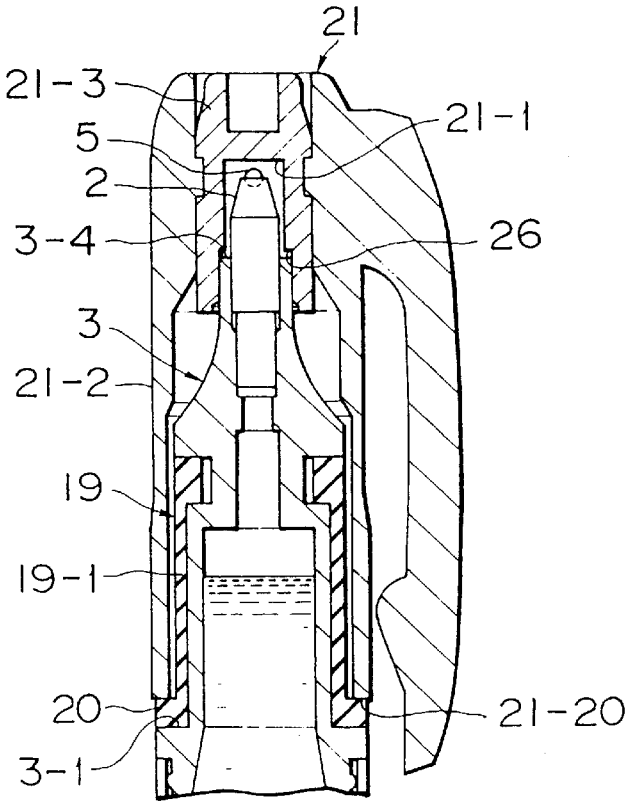
FIG. 12 is a longitudinal section for showing a state in which an opening end surface of a cap is abutted against a cap returning resilient part of a resilient member during a loading step against the extremity end.
Figure 13A:
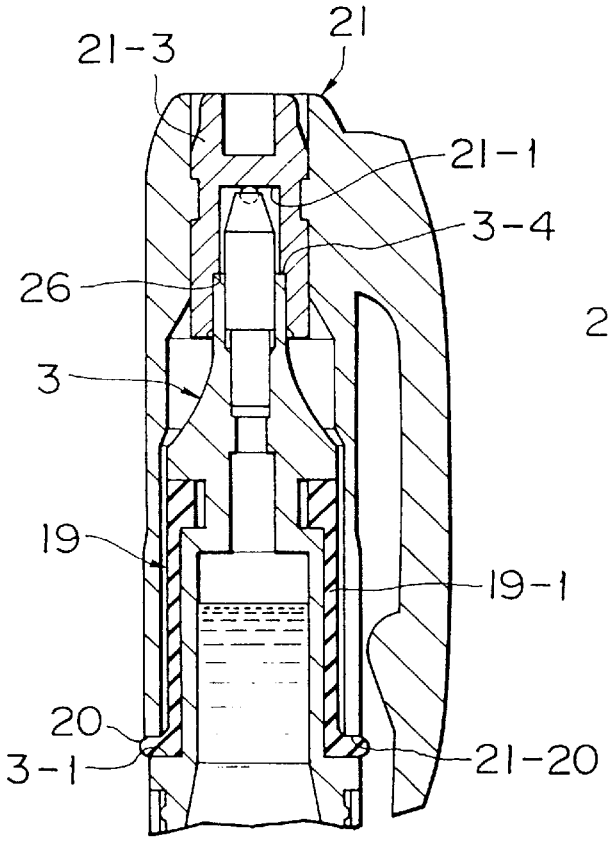
FIG. 13A is a longitudinal section for showing a state (a valve opened state) in which a cap returning resilient part of a resilient member is resiliently deformed while being pushed by an opening end surface of the cap during a loading step against the extremity end.
Figure 13B:
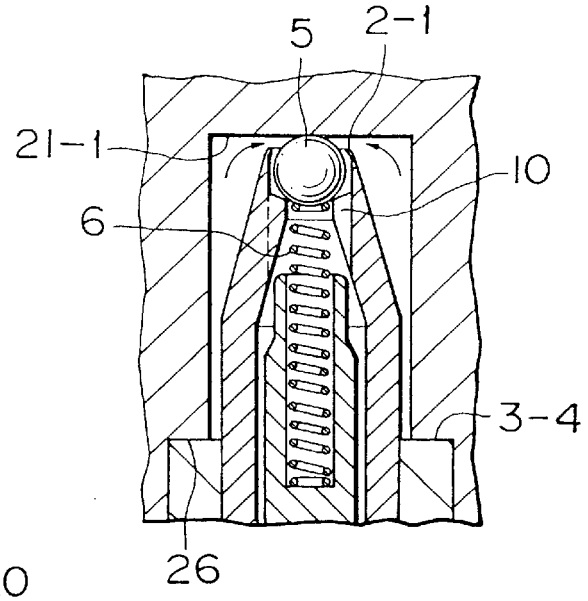
FIG. 13B is an expanded view of main point of FIG. 13A.

Then, an example of usage of the writing tool of the present embodiment constructed as described above will be described as follows, wherein the inner cap 21-3, under its close contacted state with an outer periphery of the reduced diameter cylindrical part 3—3 of the extremity end 3 (a state shown in FIG. 11A), is pushed until the opening end surface 21-20 of the cap 21 is abutted against the cap returning resilient part 20 of the resilient member 19 which is present under its state abutted against the cap loading base end 3-1 (a state shown in FIG. 12). At this time, the air in the inner cap 21-3 is pressurized and compressed, passes through a clearance 25 in respect to the cylindrical part 19-1 of the resilient member 19 without being remained in the cap main body 21-2 and then the air is automatically discharged into the surrounding air (refer to FIG. 11A). Accordingly, during the loading step against the extremity end 3, it is possible to load the cap 21 without being applied by a load resistance caused by remained air in the cap main body 21-2. That is, it is possible to load the cap 21 only with a low force of a close contacting force of the inner cap 21-3 in respect to the extremity end (the "writing position" of the rotary member 5 is shown in FIGS. 11A–12).

Figure 10:
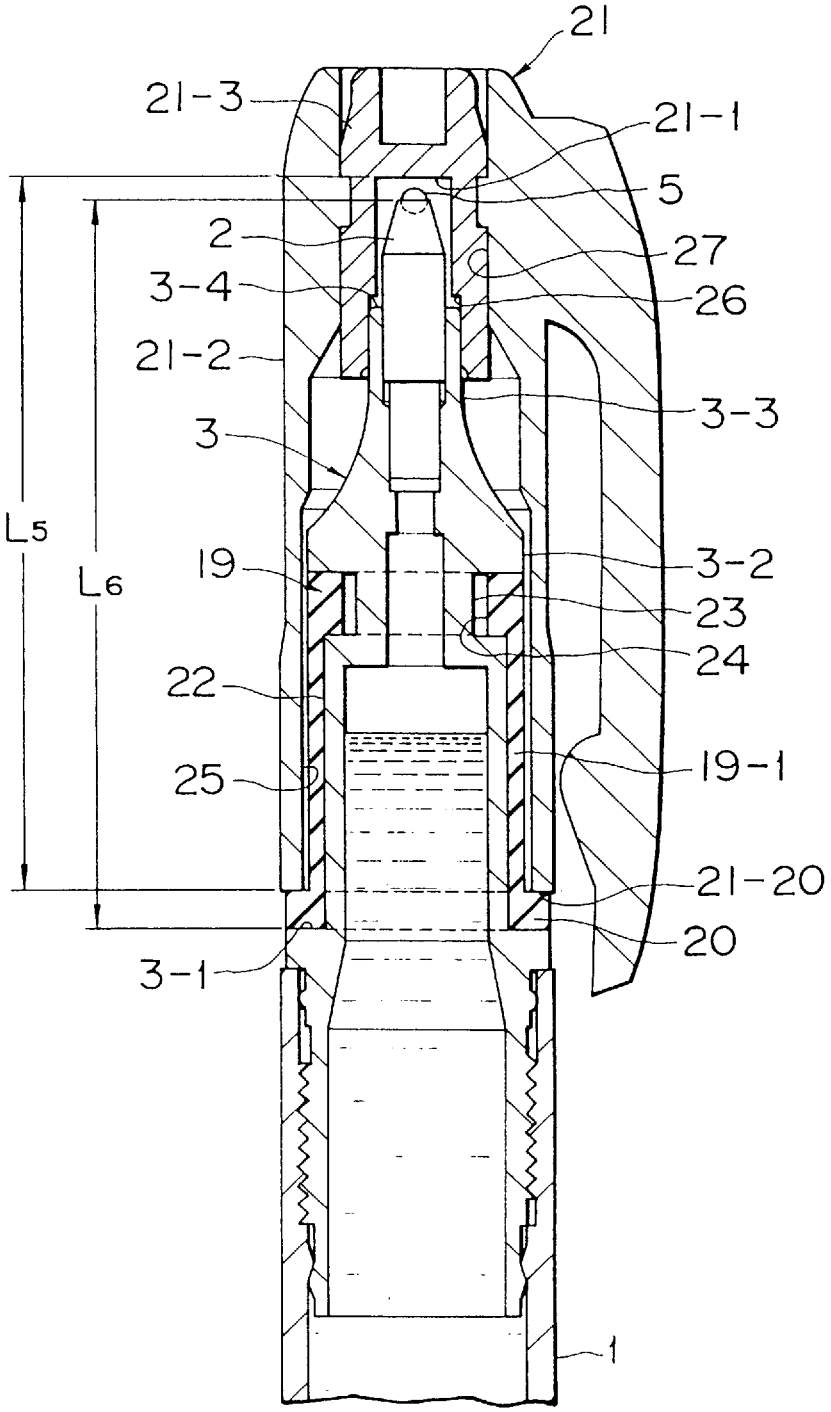
FIG. 10 is a longitudinal section for showing an embodiment of the writing tool of the present invention.

Then, the opening end surface 21-20 of the cap 21 is abutted against the cap returning resilient part 20 and further pushed. Then, during a step in which the stepped part 26 of the inner cap 21-3 is abutted against the extremity end surface 3-4 of its reduced diameter cylindrical part 3—3 of the extremity end 3 so as to restrict a loading and moving amount in respect to the extremity end 3, the cap returning resilient part 20 is resiliently deformed and concurrently, the inner bottom part 21-1 of the inner cap 21-3 is abutted against the rotary member 5 projected out of the extremity end of the tip 2, the rotary member 5 is retracted inwardly toward the tip 2 in such a manner that it may be moved away from the inward extremity edge 2-1 of the tip 2 against the spring 6 so as to open the valve structure located at the extremity end of the tip 2 (a state shown in FIG. 13A & 13B). That is, as shown in FIG. 10, at the normal loading position in respect to the extremity end 3, the inner bottom part 21-1 of the inner cap 21-3 spaced apart from the extremity end of the tip 2 is abutted against the rotary member 5 projected out of the extremity end of the tip 2 by a method wherein the cap 21 is pushed in respect to the extremity end 3 until the opening end surface 21-20 of the cap 21 is abutted against the cap returning resilient part 20 at the cap loading base end 3-1 and the cap returning resilient part 20 is resiliently deformed, and the rotary member 5 is retracted inwardly toward the tip 2. With such an operation as above, the valve structure located at the extremity end of the tip 2 is opened, the compressed air in the inner cap 21-3 is fed into the liquid tank 1 through the clearance between the valve opened inward extremity edge 2-1 and the rotary member 5 so as to increase an inner pressure in the liquid tank 1.

In turn, as the pushing operation for the cap 21 is released (the cap 21 is released), the cap 21 is pushed back to the normal loading position in respect to the extremity end 3 by a recovering force (a resilient force) where the cap returning resilient part 20 returns to its original state before deformation and concurrently the inner bottom part 21-1 of the inner cap 21-3 is moved away from the rotary member 5 (returned back to the state shown in FIG. 10). With such an operation as above, the rotary member 5 is contacted with the inward extremity edge 2-1 of the tip 2 by the spring 6 so as to close the valve structure located at the extremity end.

FIGS. 14A to 15B illustrate sixth embodiment of the writing tool of the present invention.

Figure 14A:
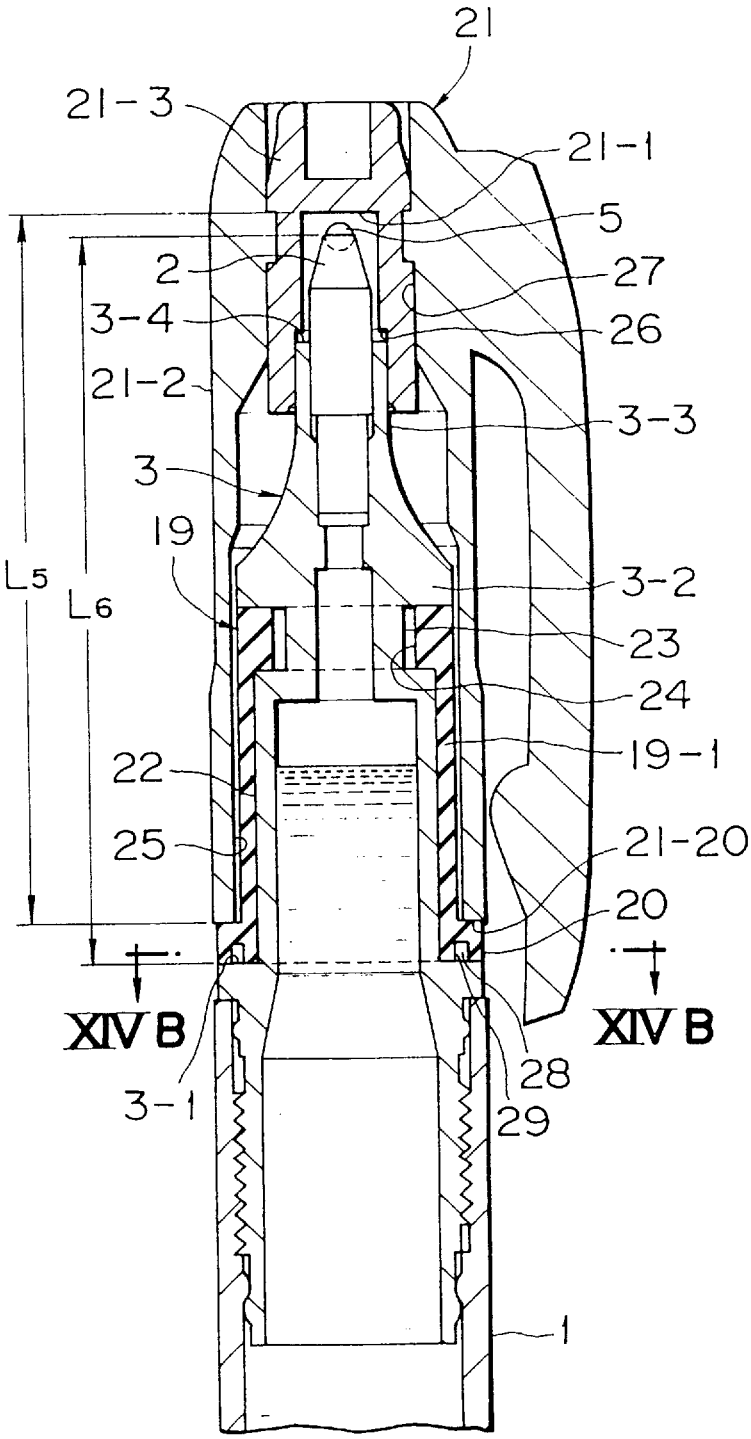
FIG. 14A is a longitudinal section for showing an embodiment of the writing tool of the present invention.
Figure 14B:
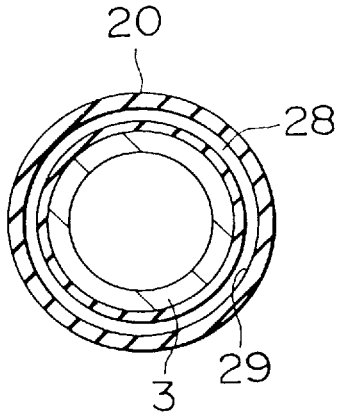
FIG. 14B is a section taken along a line XIVB—XIVB of FIG. 14A.

FIGS. 14A and 14B show a sixth embodiment, a system in which an annular end surface of the cap returning resilient part 20 in a general structure similar to the fifth embodiment, is provided with an (annular) indent recess 29 for keeping a deformed space 28 of the cap returning resilient part 20 in respect to the cap loading base end 3-1, the cap 21 is pushed onto the extremity end 3, its opening end surface 21-20 is abutted against the cap returning resilient part 20, then as it is pushed, the cap returning resilient part 20 is resiliently deformed in such a manner that the cap returning resilient part 20 is released into the deformation space 28, then as the pushing operation is released, the recovering force of the cap returning resilient part 20 is augmented by the compressed air within the compressed and deformed space as the cap returning resilient part 20 is resiliently deformed. In the sixth embodiment, the same reference numerals are applied to the elements substantially similar to those of the fifth embodiment and the description thereof is omitted.

The indent recess 29 is formed into a groove having a proper depth and an opening width at the annular end surface of the cap returning resilient part 20 abutted against the cap loading base end 3-1, the cylindrical part 19-1 is loaded in the indent part 22 of the extremity end 3, thereby an annular deformed space 28 is assured in respect to the cap loading base end 3-1 (refer to FIG. 14B).

Thus, according to the writing tool of the sixth embodiment, the cap 21 is pushed onto the extremity end 3 to cause its opening end surface 21-20 to be abutted against the cap returning resilient part 20 of the resilient member 19 and further pushed. Then, the cap returning resilient part 20 is pushed by the opening end surface 21-20 of the abutting cap 21 and resiliently deformed in such a manner that it is released into the deforming space 28 assured in respect to the cap loading base end 3-1 and concurrently as it is resiliently deformed, the inner bottom part 21-1 of the inner cap 21-3 is abutted against the rotary member 5 projected out of the extremity end of the tip 2 so as to open the valve structure located at the extremity end of the tip 2 as described in detail in the aforesaid embodiment.

In turn, when the pushing operation is released after the stepped part 26 of the inner cap 21-3 is abutted against the extremity end surface 3-4 of the reduced diameter cylindrical part 3—3 of the extremity end 3 and pushed until a loading and moving amount in respect to the extremity end 3 is restricted, the cap 21 is pushed back to the normal loading position in respect to the extremity end 3 with the recovering force of the cap returning resilient part 20 augmented by the compressed air in the deformed space 28 compressed during the pushing operation of the cap 21 so as to close the valve structure located at the extremity end of the tip 2 as described in detail in the aforesaid embodiment.

Figure 15A:
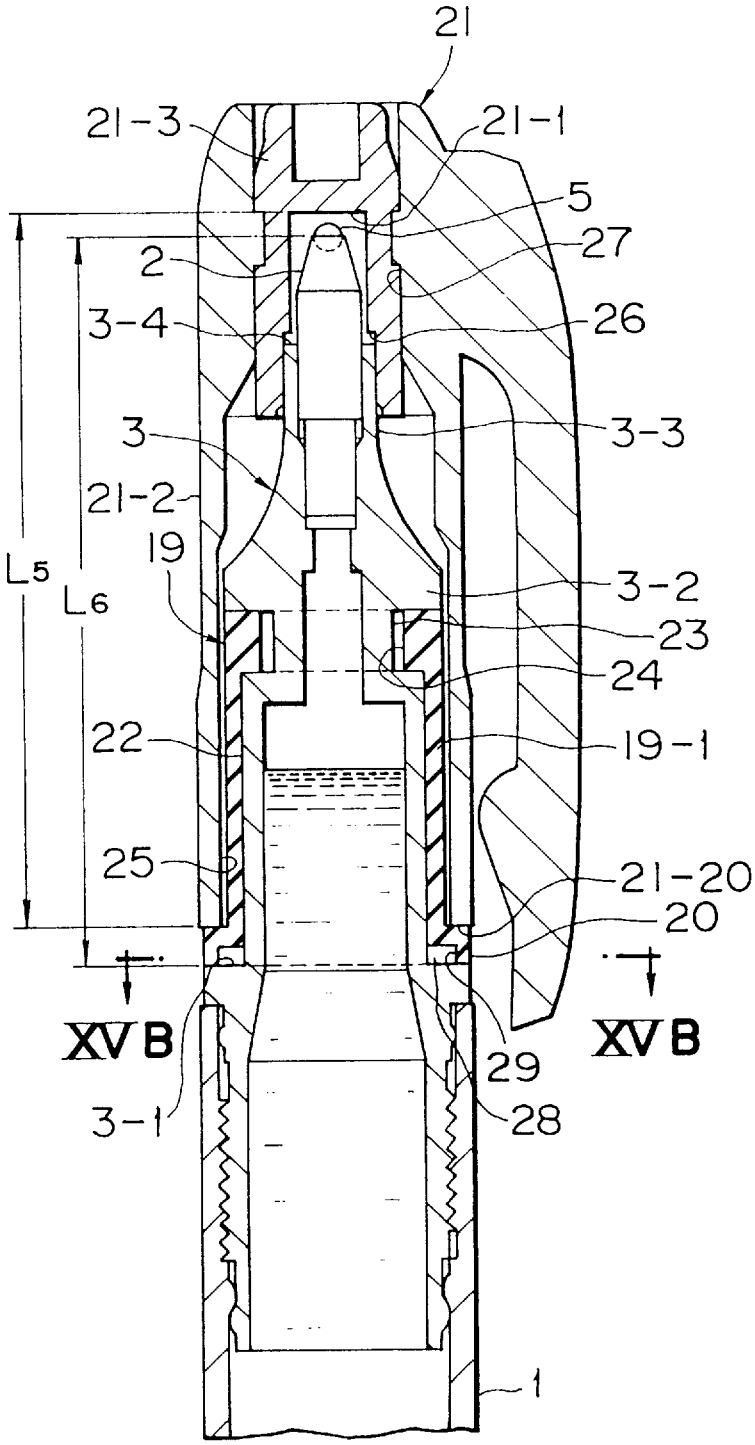
FIG. 15A is a longitudinal section for showing another embodiment of the writing tool of the present invention.
Figure 15B:
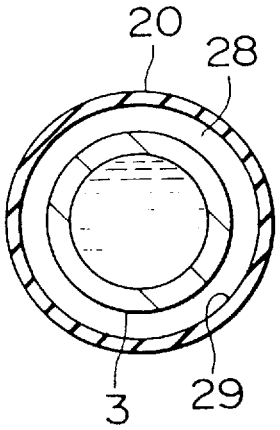
FIG. 15B is a section taken along a line XVB—XVB of FIG. 15A.
Figure 16:
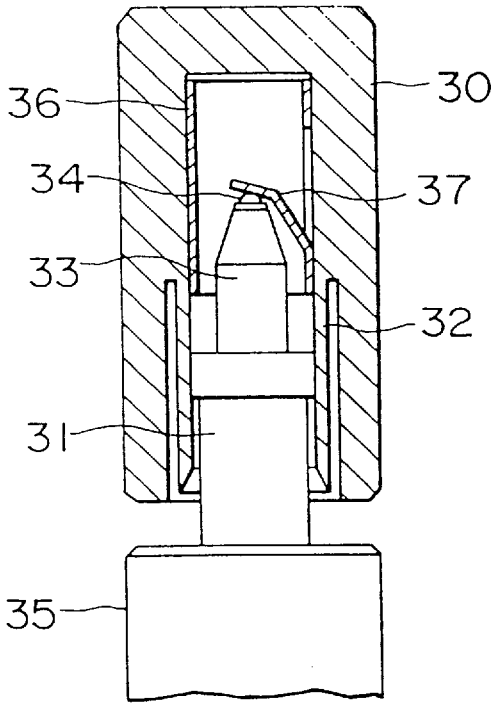
PRIOR ART FIG. 16
FIG. 16 is a longitudinal section for showing the prior art writing tool.

FIGS. 15A and 15B illustrate a seventh embodiment in which the shape of the opening of the indent recess 29 in the (annular) aforesaid embodiment described in detail is changed, wherein, the indent recess 29 is formed into a substantial L-shaped section opened from the annular end surface of the cap returning resilient part 20 abutted against the cap loading base end 3-1 toward the inner surface of the cylindrical part 19-1, and a deformed space 28 is kept between the cap loading base end 3-1 of the extremity end 3 and its outer circumference, so-called bottom part of the indent 22.

Accordingly, in accordance with the writing tool of the seventh embodiment of the present invention constructed as described above, the valve opening operation in which the rotary member 5 projected out of the tip 2 is retracted inwardly toward the tip 2 in order to feed the compressed air in the compressed cap 21 into the liquid tank 1 during the cap 4 loading step in respect to the extremity end 3 is performed by the inner bottom part 21-1 of the cap 4 in the same manner as that of the sixth embodiment described in detail, so that it can be kept positively and stably for a long period of time.

In addition, the cap returning resilient part 20 is pushed to be released toward its deformed space 28 and resiliently deformed. In other words, since a high pushing force is not required when the cap 21 pushing operation in respect to the extremity end 3 is carried out, children or ladies can handle the writing tool easily and this is substantially convenient in operation.

Further, since the recovering force of the cap returning resilient part 20 for pushing back the cap 4 up to the normal loading position of the extremity end 3 is augmented by the compressed air in the compressed and deformed space 28 during pushing operation of the cap 4, its positive characteristic can be attained. In addition, the cylindrical part 19-1 of the resilient member 19 may act to grip for preventing a slippage of the writing tool when it is used for correcting the wrong letters.

Further, the colored inner cap 21-3 which may act to be closely contacted with an outer periphery of the extremity end 3 to sealingly close the tip 2 and to compress inner air and act to keep the rotary member 5 spaced apart from the inward extremity edge 2-1 of the tip 2 in order to feed compressed air into the liquid tank 1 and to open the valve structure located at the extremity end 3 of the tip 2 is stored within the transparent cap main body 21-2. The ornamental effect of the cap 21 is improved. In addition, since the inner cap 21-3 may act to abut against the extremity end surface of the extremity end 3 when the valve structure located at the extremity end 3 of the tip 2 is opened so as to restrict the loading and moving amount of the cap 21 in respect to the extremity end 3, the compressed air in the inner cap 21-3 which is pressurized and compressed is positively fed into the liquid tank 1.

As writing tool of the present invention is constructed as described above, the valve opening operation in which the rotary member projected out of the tip is retracted inwardly toward the tip in order to feed the compressed air in the compressed cap into the liquid tank during the cap loading step in respect to the extremity end is performed by the inner bottom part of the cap, so that the operation for opening valve when the compressed air in the cap is fed into liquid tank can be kept positively and stably for a long period of time. Accordingly, the writing tool of the present invention is preferable as a writing tool in which an inner pressure in the liquid tank is increased by feeding compressed air of the cap into the liquid tank during the cap loading step and also that the liquid in the tank is fed into writing portion of the extremity end of the tip by utilizing said inner pressure. For example, it is useful as a tool for coating correcting fluid and so on that correcting fluid filled in liquid tank is fed into writing portion of the extremity end of the tip by increasing internal pressure of the tank during the writing step and thus the correcting fluid is applied to mistakenly written letters.

What is claimed is:

1. A writing tool, comprising:

a pen body having a step formed therein, having:

a liquid tank;

an extremity end having an outer cylindrical surface and a tip, said extremity end and said tip having a channel therethrough connected to the liquid tank, and said tip having a retaining rim formed therein at an end of said channel;

a rotary member held within said channel, said rotary member being retained within said channel by said retaining rim and movable between a writing position that blocks said channel at said retaining rim and a pressurizing position that unblocks said channel at said retaining rim;

a spring within said channel, the spring biasing said rotary member toward said writing position; and a resilient member; and a cap, said cap having:

a cavity formed therein, having an inner circumferential surface and an inner end surface, said inner circumferential surface forming a seal with said outer cylindrical surface of said extremity end when said cap is attached to said extremity end, said seal thereby allowing compression of air within said cavity; and a rim;

a distance between said rim and said inner end surface being substantially the same as a distance between said step and said rotary member in said pressurizing position so that said rotary member is moved from said writing position to said pressurizing position when said rim is pushed sufficiently close to said step, and said resilient member being positioned to intervene between said cap and said pen body when said cap is attached to said extremity end so that said rim is biased by said resilient member away from said step when said rim is pushed sufficiently close to said step.

2. The writing tool according to claim 1, said step being a circumferential step formed in said pen body, and said resilient member being a resilient O ring positioned on said circumferential step to intervene between said rim and said circumferential step when said cap is attached to said extremity end, so that said rim is biased by said resilient O ring away from said circumferential step when said rim is pushed sufficiently close to said circumferential step.

3. The writing tool according to claim 1, said step being a circumferential step formed in said pen body, and said resilient member being a resilient leaf spring positioned on said circumferential step to intervene between said rim and said circumferential step when said cap is attached to said extremity end, so that said rim is biased by said resilient leaf spring away from said circumferential step when said rim is pushed sufficiently close to said circumferential step.

4. A writing tool, comprising:

a pen body having a step formed therein, said pen body having:

a liquid tank;

an extremity end having an outer cylindrical surface and a tip, said extremity end and said tip having a channel therethrough connected to the liquid tank, and said tip having a retaining rim formed therein at an end of said channel;

a rotary member held within said channel, said rotary member being retained within said channel by said retaining rim and movable between a writing position that blocks said channel at said retaining rim and a pressurizing position that unblocks said channel at said retaining rim; and a spring within said channel, the spring biasing said rotary member toward said writing position; and a cap, said cap having:

a cavity formed therein, having an inner circumferential surface and an inner end surface, said inner circumferential surface forming a seal with said outer cylindrical surface of said extremity end when said cap is attached to said extremity end, said seal thereby allowing compression of air within said cavity;

a rim, a distance between said rim and said inner end surface being substantially the same as a distance between said step and said rotary member in said pressurizing position so that said rotary member is moved from said writing position to said pressurizing position when said rim is pushed sufficiently close to said step; and a resilient member, within said cap, intervening between said inner end surface and a portion of said extremity end so that said rim is biased by said resilient member away from said step when said rim is pushed sufficiently close to said step.

5. The writing tool according to claim 4, said resilient member being a spring.

6. A writing tool, comprising:

a pen body having a step formed therein, said pen body having:

a liquid tank;

an extremity end having an outer cylindrical surface and a tip, said extremity end and said tip having a channel therethrough connected to the liquid tank, and said tip having a retaining rim formed therein at an end of said channel;

a rotary member held within said channel, said rotary member being retained within said channel by said retaining rim and movable between a writing position that blocks said channel at said retaining rim and a pressurizing position that unblocks said channel at said retaining rim;

a spring within said channel, the spring biasing said rotary member toward said writing position; and a resilient member surrounding a portion of the outer peripheral surface of said extremity end along a length thereof; and a cap, said cap having:

a cavity formed therein, having an inner circumferential surface and an inner end surface, said inner circumferential surface forming a seal with said outer cylindrical surface of said extremity end when said cap is attached to said extremity end, said seal thereby allowing compression of air within said cavity; and a rim;

a distance between said rim and said inner end surface being substantially the same as a distance between said step and said rotary member in said pressurizing position so that said rotary member is moved from said writing position to said pressurizing position when said rim is pushed sufficiently close to said step, and at least a portion of said resilient member being positioned to intervene between said cap and said pen body when said cap is attached to said extremity end so that said rim is biased by said resilient member away from said step when said rim is pushed sufficiently close to said step.

7. The writing tool according to claim 6, said step being a circumferential step formed in said pen body, and said resilient member being generally cylindrical, extending from said step along said extremity end, and including a unitarily formed resilient circumferential ring projecting therefrom at said circumferential step to intervene between said rim and said step when said cap is attached to said extremity end, so that said rim is biased by said unitarily formed resilient circumferential ring away from said circumferential step when said rim is pushed sufficiently close to said circumferential step.

8. The writing tool according to claim 7, said unitarily formed resilient circumferential ring having an annular indent recess formed therein for augmenting a biasing property of said unitarily formed resilient circumferential ring when said rim is pushed sufficiently close to said circumferential step.

9. The writing tool according to claim 6, said cap comprising:

a transparent main body having an inner diameter approximately twice that of an outer diameter of said extremity end, said transparent body including said rim; and a colored cylindrical inner cap within said transparent main body and visible therethrough, said colored cylindrical inner cap including said cavity formed therein, said inner circumferential surface, and said inner end surface;

wherein said colored cylindrical inner cap is fixedly mounted within said transparent main body with a distance between said rim of said transparent main body and said inner end surface of said colored cylindrical inner cap being substantially the same as a distance between said step and said rotary member in said pressurizing position, so that said rotary member is moved from said writing position to said pressurizing position when said rim of said transparent main body is pushed sufficiently close to said step.

* * * * *